US006259653B1

(12) United States Patent
Courson et al.

(10) Patent No.: US 6,259,653 B1
(45) Date of Patent: Jul. 10, 2001

(54) PORTABLE ENCAPSULATED UNDERWATER ULTRASONIC CLEANER

(75) Inventors: Billy Courson, Panama City Beach; John Shelburne, Lynn Haven, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/638,807

(22) Filed: Aug. 14, 2000

(51) Int. Cl.[7] ..... B63B 59/06
(52) U.S. Cl. ..... 367/141; 114/222
(58) Field of Search ..... 114/222; 367/142, 367/141, 910; 134/1

(56) References Cited

U.S. PATENT DOCUMENTS 3,068,829 * 12/1962 Nuissl ..... 114/222
3,673,555 * 6/1972 Raudsep ..... 367/137
4,444,146 * 4/1984 De Witz et al. ..... 114/222
4,890,567 * 1/1990 Carduff ..... 114/222
5,540,172 * 7/1996 Goldbach et al. ..... 114/222

* cited by examiner

*Primary Examiner*—Ian J. Lobo
(74) *Attorney, Agent, or Firm*—Harvey A. Gilbert; Donald G. Peck

(57) ABSTRACT

A portable, diver-operated device provides an improved method of cleaning surfaces underwater. The device includes a source of ultrasonic energy in a housing that has a compliant portion around an opening to engage and fit around a contaminated surface and clean it with the ultrasonic energy. The housing is made from material that diminishes transmission of the ultrasonic energy to ambient water. The compliant portion seals the source, the contaminated surface and some water from ambient water to concentrate the cleaning power of the source on the surface and to prevent transmission of harmful levels of energy outside of the device and through ambient water.

25 Claims, 1 Drawing Sheet

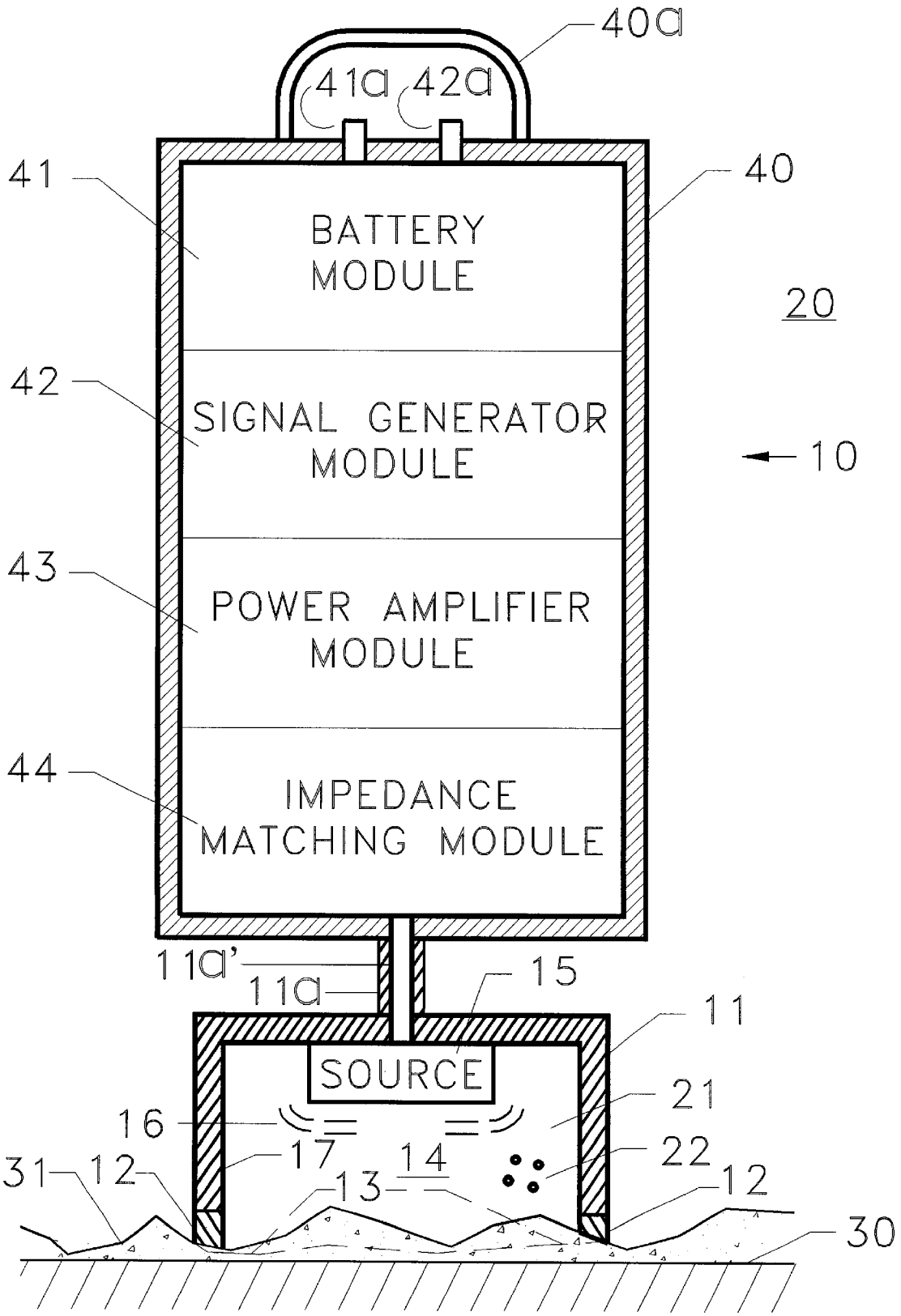
40a
41a
42a
41
40
BATTERY MODULE
20
42
SIGNAL GENERATOR MODULE
10
43
POWER AMPLIFIER MODULE
44
IMPEDANCE MATCHING MODULE
11a'
11a
15
11
SOURCE
21
16
17
14
22
31
12
13
12
30

PORTABLE ENCAPSULATED UNDERWATER ULTRASONIC CLEANER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to cleaning devices for underwater surfaces. More particularly, the cleaning device of this invention is portable by a diver and uses ultrasonic energy to clean contamination from surfaces underwater.

Underwater surfaces are cleaned, or otherwise prepared by a number of methods. Many of these methods use brushes, scrapers and/or water-jets for abrasive cleaning and surface preparation that include rust and scale removal, paint and coating removal, and marine growth removal. The support systems for these methods are too large and heavy to be carried by a single diver, and they usually require operational support from equipment located on the surface. Consequently, they are not truly portable and their use may attract unwanted attention. In addition, the systems consume large quantities of power and are expensive.

Ultrasonic energy has been widely used commercially in baths in open sinks at surface installations for measurement, protection, and cleaning operations. Ultrasonic energy is transmitted through the unsealed open baths that may include cleaning, or abrasive solutions to effectively clean parts; however, the sinks are inefficient and relatively bulky fixed structures and by their very nature cannot be used to clean surfaces underwater.

A commercially available tool marketed under the trademark SONICATOR by MISONIX Incorporated of 1938 New Highway, Farmingdale, N.Y., 11735 has shown promise for underwater cleaning of some contaminants (grease, dirt, grime, hardened thread locking compound, etc.) from parts. It has a one-half inch diameter probe-like tip that is brought about one-half inches from or in contact with contaminated surfaces on the parts. Compared to topside standard sinks that use ultrasonic energy, the power (550 watts at 20 kHz) of the probe-like tool was found to clean the parts about ten times faster, but it did not remove marine barnacle and mollusk shell growth except to clean the surfaces of the growth. In addition, the mid-frequency noise levels that were generated by cavitation bubble formation on the tip of the probe were appreciable and are likely to be unacceptable when used near some sensors and ordnance.

Thus, in accordance with this inventive concept, a need has been recognized in the state of the art for an ultrasonic cleaner portable by a diver-operator that seals a surface to be cleaned from ambient water and retains ultrasonic energy to clean the surface underwater.

SUMMARY OF THE INVENTION

The present invention provides an underwater tool that includes a source of ultrasonic energy in a shell-shaped housing having an opening to engage and fit around a surface to clean the surface with the ultrasonic energy. The shell retains the ultrasonic energy inside of it and a compliant portion around the opening seals the source of ultrasonic energy, the surface, and some water from the ambient water. The invention also includes a method of cleaning a surface underwater using the underwater tool.

An object of the invention is to provide a method of and device for using ultrasonic energy to clean a surface underwater.

Another object is to provide a method of and portable device for cleaning an underwater surface that seals the surface and an ultrasonic energy source from ambient, or surrounding water.

Another object is to provide a method of and portable device for cleaning an underwater surface that seals the surface, an ultrasonic energy source and some liquid from ambient water.

Another object is to provide a method of and device for cleaning an underwater surface that diminishes transmission of energy to ambient water.

Another object is to provide a method of and portable device for cleaning an underwater surface having a housing made from material absorptive of ultrasonic energy to reduce the level of energy transmitted to ambient seawater.

Another object is to provide a method of and portable device for cleaning an underwater surface having a housing with an internal coating to reduce the level of energy transmitted to ambient seawater.

Another object is to provide a method of and portable device for cleaning an underwater surface having a housing with an internal reflective coating to reflect energy in a chamber to enhance cleaning.

Another object of the invention is to provide a method of and device for cleaning a surface underwater using a dish-shaped shell having at least a compliant portion around an opening to retain ultrasonic energy and seal a source of ultrasonic energy, the surface and some water in a chamber from ambient water.

These and other objects of the invention will become more readily apparent from the ensuing specification when taken in conjunction with the appended claims.

BRIEF DESCRIPTION OF THE DRAWINGS

The FIGURE is a schematic representation of the device of the invention shown partially in cross section for cleaning contaminants from a surface underwater.

DESCRIPTION OF THE PREFERRED EMBODIMENT

Referring to the FIGURE, cleaning device 10 is portable by a diver-operator and can be deployed at various depths in water 20 to clean a surface 30 of contaminants 31. Surface 30 can be metal (or other materials) of undersea structural components, instrumentation packages, sensors, ordnance, etc. Contaminants 31 can include fouling caused by marine growth including barnacle shells, mollusk shells, plus a host of other marine growth and organisms, and/or a number of chemical compounds such as rust, scale, sand, grease, dirt, grime, etc.

Cleaning device 10 has a waterproof container 40 and is sized to be portable by a diver, although larger versions of cleaning device 10 may need more than one diver to transport it. Container 40 can have a handle 40*a* at one end for carrying and positioning it, and an essentially dish-shaped shell, or housing 11 functioning as a conformal enclosure is mounted on the other end of container 40.

One configuration of shell-shaped housing 11 has an annular lip-shaped portion 12 around opening 13. Annular portion 12 is made from a material that is compliant enough to pliably conform to surface 30 and contaminants 31 as it engages them to seal a chamber 14 inside housing 11 and adjacent to surface 30 and contaminants 31.

A source of ultrasonic energy 15 is disposed in chamber 14 to project, or transmit ultrasonic energy 16. The projected energy usually passes through some water 21 that has been part of ambient water 20 before cleaning device 10 was placed on surface 30 and contaminants 31.

Housing 11 and annular portion 12 can be integral with each other and can be formed as a molded elastomeric unit. A preferred choice is polyurethane as an elastomeric material that assures sealing, and another good choice is compliant natural rubber. Other natural and manmade materials can be used as long as they are compliant enough to conform to surface 30 and its contaminants 31 to seal chamber 14 from surrounding, or ambient water 20. The compliant seal created by annular portion 12 seals source 15, surface 30 and contaminants 31 and some water 21 from ambient water 20 to concentrate the cleaning power of ultrasonic energy 16 from source 15 on contaminants 31 on surface 30 in chamber 14. The compliant seal created by annular portion 12 also prevents transmission of harmful levels of ultrasonic energy 16 and mid-frequency energies outside of housing 11 of cleaning device 10.

In addition, the chosen material for housing 11 and portion 12 has suitable properties of absorption of ultrasonic energy 16 in the range of about 20 to 35 kHz. and mid-frequency noise in the range of about 10 to 1500 Hz. A material of such absorptional properties will serve to isolate, or at least diminish the transmission of portions of ultrasonic energy 16 and mid-frequency noise from chamber 14 to ambient water 20. The undesirable mid-frequency noise is generated largely due to the formation and/or collapse of cavitation bubbles during projection of ultrasonic energy 16 from source 15 within chamber 14. The compliant material, natural rubber, has such properties of absorption. The lead-impregnated vinyl material designated DSB-1 marketed under the trademark QUIET MAT by Noise Reduction Enterprises, Marine Products Division, Essex, Mass. 01929-0907 is another satisfactory sound absorbing material Other natural and manmade materials can be used as well.

A septum or suitable coating 17 can be provided on the inside of housing 11 and annular portion 12 in chamber 14 to reflect portions of ultrasonic energy 16 (and possibly mid-frequency energy) back onto surface 30 and contaminants 31 in chamber 14 in addition to reflections of other portions of ultrasonic energy (and possibly mid-frequency energy) caused by housing 11. The shape of housing 11 reflects energy onto surface 30 and contaminants 31. However, housing 11 can have different shapes, such as curved, or cone-shaped to improve reflection of ultrasonic energy from coating 17 onto surface 30 and can help focus ultrasonic energy onto surface 30. These features help reduce transmission of possibly harmful levels of energy to the operator of cleaning device 10 and other unwanted listeners. The energy reflected can add to the process of cleaning contaminants 31 from surface 30.

Housing 11 may be made from different materials than portion 12 when enhancement of different properties may be called for, for example, when a larger cleaning unit for larger surfaces needs a material that has additional structural strength. However, these different materials enhance the isolation, or at least diminishment of the transmission of ultrasonic energy 16 from chamber 14 to ambient water 20, as compared to the material used in annular portion 12 that is likely to be primarily selected for its compliant properties to seal chamber 14 from ambient water 20. In this configuration, material of housing 11 could be the material DSB-1 marketed under the trademark QUIET MAT by Noise Reduction Enterprises, and annular portion 12 could be compliant polyurethane, although other suitable materials might be selected as well Source 15 of ultrasonic energy can be a piezoelectric transducer appropriately driven to provide suitable levels of projected, or transmitted ultrasonic energy 16. Many different piezoelectric transducers available in the art are acceptable. The frequency and ranges of frequency of the projected signals of ultrasonic energy 16 and the power of the signals of the projected energy from the selected transducers can be selected and tuned by modular components to be identified below. Thus, cleaning of different contaminations 31 on surface 30 can be optimized, and cleaning times can be reduced.

Optionally, source 15 can include a plurality, or an array of piezoelectric transducers in chamber 14. The signals projected from the transducers can be phased in accordance with known phasing techniques to focus a composite form of ultrasonic energy 16 onto surface 30 and contaminants 31. This capability assures thoroughness and rapid completion of the cleaning process. Individual ones of the selected transducers or arrays of from one to five transducers typically project levels of ultrasonic energy, or power from source 15 that range from 500 to 2500 watts. This creates typical, or exemplary levels of power concentration of about 31 to 156 watts per cubic inch in a four-inch diameter, or sixteen cubic inch volume chamber 14.

Housing 11 has a shank portion 11*a* coupling it to sealed container 40 and transmitting electrical power to drive each transducer of source 15 via leads 11*a*'. Shank portion 11*a* may also have hydraulic and/or mechanical links and couplings (not shown) between container 40 and source 15. Container 40 is sealed and waterproof and encapsulates battery module 41, signal generator module 42, power amplifier module 43 and impedance matching module 44 that may also be individually sealed units and are operatively connected together via connections (not shown) to deliver suitable power to drive source 15.

Battery module 41 delivers sufficient, selectable levels of power to the other modules when a waterproof dial-type switch 41*a*, for example, is actuated by a diver-operator. Signal generator module 42 produces ultrasonic signals in preselected frequencies and ranges when appropriately tuned by an operator via waterproof dial-type tuning switch 42*a*, for example. The selected ultrasonic signals are amplified in power amplifier stage 43, and fed to impedance matching module 44 where maximum power transfer to transducer 15 is provided for. These modules and their tuning features are known in the art, and one of ordinary skill in the art to which this invention pertains will readily fabricate or select suitable modules and their tunable features from commercial sources.

As a further option, source 15 could be only a radiating, or projection structure in chamber 14. The rest of the transducer could be contained inside container 40 with mechanical or hydraulic couplings through shank 11a that link the transducer to projection structure of source 15. This option may allow more powerful transducers to create higher levels of cleaning power.

In operation, cleaning device 10 is so compact and portable that it can be carried by a diver-operator to a remote, underwater work site where surface 30 is to be cleaned of contaminants 31. Grasping handle 40*a* and a portion of container 40, the diver places annular portion 12 against and around surface 30 and contaminants 31 and exerts a slight pushing, or pressing force. This pressing force holds cleaning device 10 against surface 30 and contaminants 31 and slightly deforms the compliant material of annular portion 12. Annular portion 12 pliably accommodates, or engages surface 30 and contaminants 31 to seal source 15, surface 30 and contaminants 31, and some water 21 in chamber 14 from ambient water 20. The diver may add some abrasive, or other cleaning additive 22 to water 21 in chamber 14 from a syringe-like applicator or packet to assist the cleaning process, if desired.

Source 15 of ultrasonic energy is activated by the diver's actuation of switch 41*a*. Ultrasonic energy 16 from source 15 is projected from source 15 into water 21 in chamber 14 and onto contaminants 31. The relatively small size of chamber 14 serves to concentrate projected ultrasonic energy 16 from source 15 onto surface 30 and contaminants 31. Typically, concentrated levels of ultrasonic energy in the range of 31 to 156 watts per cubic inch are suitable to remove most contaminants 31, and these levels can be transmitted by suitable control of switch 41*a*.

Another factor to consider in the removal of contaminants is selection of frequencies of ultrasonic energy 16. Different frequencies of projected ultrasonic energy 16 can affect the efficiency of removal of contaminants 31 and may be generated in signal generator module 42. They are selected or tuned by the diver's control of tuning switch 42*a*. The selected composition and power of ultrasonic energy 16 are projected from source 15 into chamber 14 and onto surface 30 and contamination 31. Ultrasonic energy 16, as well as mid-frequency noise generated by cavitation bubbles are retained or isolated, or at least diminished from transmission to ambient water 20 by the material of housing 11. The shape of housing 11 and coating 17 reflect portions of projected ultrasonic energy 16 toward surface 30 and contaminants 31 to assist, or enhance the cleaning process and reduce the problems associated with unwanted transmissions of such energy through ambient water 20.

Having the teachings of this invention in mind, modifications and alternate embodiments of this invention may be adapted. Cleaning device 10 can be made in larger or smaller sizes, and housing 11 could be made from many other elastomeric materials. Housing 11 could be block-shaped and define a chamber 14 having an annular portion 12, or other configurations instead of shell-shaped. Levels of power projected by source 15 may be increased or decreased to clean contaminants 31 from differently sized surfaces 30, or different contaminants 31 from different surfaces 30 at different depths as well. Generation of different power levels and spectral compositions thereof, and the components necessary to produce them will be apparent to one skilled in the art to which this invention pertains.

The disclosed components and their arrangements as disclosed herein all contribute to the novel features of this invention. Cleaning device 10 of this invention is a portable, cost-effective tool to reliably clean contaminants 31 from surfaces 30 underwater without transmitting levels of energy that could be harmful to operators or reveal the nature of the undersea activity. Therefore, cleaning device 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An underwater tool including a source of ultrasonic energy in a housing having an opening to engage and fit around a surface to clean said surface with said ultrasonic energy, said tool being sized to be hand-held and used by a diver underwater, said housing including a dish-shaped shell having a compliant portion around said opening, said compliant portion preventing transmission of harmful levels of said ultrasonic energy and mid-frequency noise outside of said housing, and said housing and said compliant portion having properties to absorb said ultrasonic energy and said mid-frequency noise.

2. An underwater tool according to claim 1 wherein said compliant portion pliably engages said surface and contaminants thereon.

3. An underwater tool according to claim 2 wherein said shell retains said ultrasonic energy in said housing and said compliant portion pliably engaging said surface and said contaminants seals said source of ultrasonic energy, said surface, said contaminants, and some water from ambient water.

4. An underwater tool according to claim 3 wherein said shell, compliant portion, said surface, and said contaminants create a chamber.

5. An underwater tool according to claim 4 wherein said source of ultrasonic energy includes at least one piezoelectric transducer in said chamber, and said shell diminishes transmission of said ultrasonic energy to said ambient water.

6. An underwater tool according to claim 5 further including interconnected power supply, signal generator, power amplifier, and impedance matching modules coupled to said transducer.

7. An underwater tool according to claim 6 wherein said power supply module, signal generator module, power amplifier module, and impedance matching module are contained in at least one watertight container.

8. An underwater tool including a source of ultrasonic energy in a housing having an opening to engage and fit around a surface to clean said surface with said ultrasonic energy, said housing including a dish-shaped shell having a compliant portion around said opening, said compliant portion pliably engaging said surface and contaminants thereon, said shell retaining said ultrasonic energy in said housing, said compliant portion pliably engaging said surface and said contaminants to seal said source of ultrasonic energy, said surface, said contaminants, and some water from ambient water, said shell, compliant portion, said surface, and said contaminants creating a chamber, said source of ultrasonic energy including at least one piezoelectric transducer in said chamber, said shell diminishing transmission of said ultrasonic energy to said ambient water; interconnected power supply, signal generator, power amplifier, and impedance matching modules coupled to said transducer, said power supply module, signal generator module, power amplifier module, and impedance matching module being contained in at least one watertight container; and a cleaning additive in said chamber to enhance cleaning of said contaminants from said surface.

9. An underwater tool according to claim 8 further including a plurality of transducers in said chamber phased to focus ultrasonic energy therefrom onto said contaminants and said surface.

10. An underwater tool according to claim 9 wherein said housing has a coating to reflect energy onto said contaminants and said surface.

11. An underwater tool according to claim 10 wherein said housing is shaped to focus energy onto said contaminants and said surface.

12. An underwater tool according to claim 4 wherein said source of ultrasonic energy includes a radiating structure in said chamber coupled to a transducer in a watertight container.

13. A method of cleaning contaminants from a surface underwater comprising the steps of:

providing a source of ultrasonic energy in a shell-shaped housing;

placing said shell-shaped housing over a surface and contaminants underwater;

sealing said source, said surface, said contaminants and some water from ambient water in said housing; and projecting ultrasonic energy from said source to said surface and said contaminants.

14. A method according to claim 13 wherein said step of sealing comprises the steps of:

providing at least an annular portion of compliant material around an opening in said housing;

pressing said compliant annular portion against said surface and contaminants thereon;

pliably engaging said surface and contaminants with said compliant annular portion; and preventing transmission of harmful levels of said ultrasonic energy and mid-frequency noise outside of said housing by said compliant portion.

15. A method of cleaning contaminants from a surface underwater comprising the steps of:

providing a source of ultrasonic energy in a shell-shaped housing;

placing said shell-shaped housing over a surface and contaminants underwater;

sealing said source, said surface, said contaminants and some water from ambient water in said housing; said step of sealing comprises the steps of:

providing at least an annular portion of compliant material around an opening in said housing;

pressing said compliant annular portion against said surface and contaminants thereon; and pliably engaging said surface and contaminants with said compliant annular portion;

projecting ultrasonic energy from said source to said surface and said contaminants; and diminishing transmission of energy through absorptional material of said housing to said ambient water.

16. A method according to claim 15 wherein said step of projecting includes the step of transmitting said ultrasonic energy through a chamber in said housing to said surface and said contaminants.

17. A method according to claim 16 further comprising the step of:

reflecting portions of energy from a coating in said chamber to said surface and said contaminants.

18. A method according to claim 17 further comprising the step of:

shaping said housing to reflect portions of said energy in said chamber to said surface and said contaminants.

19. A method according to claim 18 further comprising the step of:

adding a cleaning additive to water in said chamber to aid cleaning of said contaminants from said surface.

20. A method according to claim 19 wherein said step of projecting includes the step of driving a piezoelectric transducer with electrical power to produce said ultrasonic energy.

21. A method according to claim 20 further comprising the step of:

providing interconnected power supply, signal generator, power amplifier, and impedance matching modules for said transducer in a watertight container.

22. A method according to claim 21 wherein said steps of diminishing, reflecting, and shaping affect ultrasonic and mid-frequency energies.

23. A method according to claim 19 wherein said step of projecting includes the step of driving a radiating structure in said chamber to project ultrasonic energy by a transducer disposed in said container.

24. A device for cleaning a surface underwater comprising:

a shell-shaped housing having a chamber and a compliant portion around an opening to pliably engage a surface and contaminants thereon;

at least one piezoelectric transducer to project ultrasonic energy in said chamber to clean said contaminants from said surface with said ultrasonic energy, said housing diminishing transmission of said ultrasonic energy and mid-frequency energy therethrough to ambient water, and said pliable engagement of said surface and said contaminants by said compliant portion sealing said source of ultrasonic energy, said surface, said contaminants, and some water in said chamber from ambient water;

a watertight container containing interconnected power supply, signal generator, power amplifier, and impedance matching modules coupled to said transducer;

a cleaning additive in said chamber to enhance cleaning of said contaminants from said surface; and a coating in said chamber to reflect energy onto said contaminants and said surface.

25. A device according to claim 24 further comprising:

a plurality of transducers in said chamber phased to focus ultrasonic energy therefrom onto said contaminants and said surface, and said housing being shaped to focus ultrasonic energy onto said contaminants and said surface.

* * * * *